US006485160B1

(12) United States Patent
Sommers et al.

(10) Patent No.: US 6,485,160 B1
(45) Date of Patent: Nov. 26, 2002

(54) LED FLASHLIGHT WITH LENS

(75) Inventors: Mathew L. Sommers, Sagamore Hills, OH (US); James T. Petroski, Parma, OH (US); Greg E. Burkholder, Valley View, OH (US)

(73) Assignee: GELcore LLC, Valley City, OH (US)

( * ) Notice: Subject to any disclaimer, the term of this patent is extended or adjusted under 35 U.S.C. 154(b) by 0 days.

(21) Appl. No.: 09/681,908

(22) Filed: Jun. 25, 2001

(51) Int. Cl.[7] ..... F21Y 101/02; F21L 4/02

(52) U.S. Cl. ..... 362/184; 362/800; 362/240; 362/245

(58) Field of Search ..... 362/184, 800, 362/237, 240, 244, 245

(56) References Cited

U.S. PATENT DOCUMENTS

| | | | | | |
|---|---|---|---|---|---|
| 3,981,023 | A | | 9/1976 | King et al. | 357/17 |
| 4,501,637 | A | | 2/1985 | Mitchell et al. | 156/630 |
| 4,733,335 | A | * | 3/1988 | Serizawa et al. | 362/800 |
| 4,935,665 | A | * | 6/1990 | Murata | 362/800 |
| 5,068,771 | A | | 11/1991 | Savage, Jr. | 362/255 |
| 5,093,768 | A | * | 3/1992 | Ohe | 362/800 |
| 5,174,649 | A | | 12/1992 | Alston | 362/244 |
| 5,251,117 | A | | 10/1993 | Nagai | 362/211 |
| 5,301,063 | A | | 4/1994 | Tohmon | 359/619 |
| 5,408,395 | A | * | 4/1995 | Schmid et al. | 362/800 |
| 5,440,468 | A | | 8/1995 | Savage, Jr. | 362/226 |
| 5,490,048 | A | * | 2/1996 | Brassier et al. | 362/800 |
| 5,523,591 | A | | 6/1996 | Fleming et al. | 257/91 |
| 5,578,156 | A | | 11/1996 | Kamakura et al. | 156/275.5 |
| 5,580,156 | A | * | 12/1996 | Suzuki et al. | 362/184 |
| 5,848,839 | A | | 12/1998 | Savage, Jr. | 362/267 |
| 5,893,633 | A | * | 4/1999 | Uchio et al. | 362/800 |
| 6,095,661 | A | * | 8/2000 | Lebens et al. | 362/184 |
| 6,168,288 | B1 | | 1/2001 | St. Claire | 362/184 |

* cited by examiner

*Primary Examiner*—Laura K. Tso
(74) *Attorney, Agent, or Firm*—Fay, Sharpe, Fagan, Minnich & McKee, LLP

(57) ABSTRACT

A flashlight includes a housing, an electrical power source in the housing, a semiconductor light source, a reflector well in which the semiconductor light source is seated, and a lens over the reflector. The housing has a closed end and an open end. The semiconductor light source is electrically connected to the power source. The semiconductor light source, reflector, and lens are secured to the housing. Light produced by the semiconductor light source is reflected by the reflector and focussed by the lens in a predetermined direction.

17 Claims, 1 Drawing Sheet

LED FLASHLIGHT WITH LENS

BACKGROUND OF INVENTION

The present invention relates generally to illumination devices. It finds particular application in conjunction with illumination devices employing multiple light emitting diodes ("LEDs") and will be described with particular reference thereto. It will be appreciated, however, that the invention is also amenable to other like applications.

In the field of illumination devices, there has long been a trade-off between brightness and power conservation. It is known that the use of light emitting diodes (LEDs) consume substantially less power than incandescent light bulbs. However, typically, the radiant power of LEDs has been limited so that they have been used for primarily short-range applications such as panel indicators or indoor signs. LEDs have proven useful when their size has not been a significant factor because they are viewed from small distances. Unfortunately, use of LEDs in applications such as flashlights has been limited due to inefficient means for directing available light to desired target areas. Even with the advent of high-powered LEDs, large clusters of LEDs are required to achieve adequate target-size definition. Unfortunately, these clusters are relatively expensive and consume a considerable amount of power.

The present invention provides a new and improved apparatus and method which overcomes the above-referenced problems and others.

SUMMARY OF INVENTION

A light emitting device includes a light emitting diode, an individual reflector well in which the light emitting diode is seated, and an individual lens over an opening of the reflector. Light produced by the light emitting diode is reflected by the reflector and focussed by the lens toward a target area.

In accordance with one aspect of the invention, the reflector is coupled to the lens.

In accordance with a more limited aspect of the invention, the light emitting device is mounted on a printed circuit board.

In accordance with another aspect of the invention, the lens provides direct light refraction to the light emitting diode.

In accordance with another aspect of the invention, the lens is one of a multiple refractive and a refractive/diffractive hybrid lens.

In accordance with another aspect of the invention, a second light emitting diode is seated in a second individual reflector well. A second individual lens is over an opening of the second reflector. Light produced by the second light emitting diode is reflected by the second reflector and focussed by the second lens toward the target area.

In accordance with a more limited aspect of the invention, the lenses are matrixed.

One advantage of the present invention is that it efficiently directs light from a semiconductor light source to a target area.

Another advantage of the present invention is that it creates a uniform, bright beam pattern for an illumination device utilizing a semiconductor light source.

Still further advantages of the present invention will become apparent to those of ordinary skill in the art upon reading and understanding the following detailed description of the preferred embodiments.

BRIEF DESCRIPTION OF DRAWINGS

The invention may take form in various components and arrangements of components, and in various steps and arrangements of steps. The drawings are only for purposes of illustrating a preferred embodiment and are not to be construed as limiting the invention.

DETAILED DESCRIPTION

Figure 1:
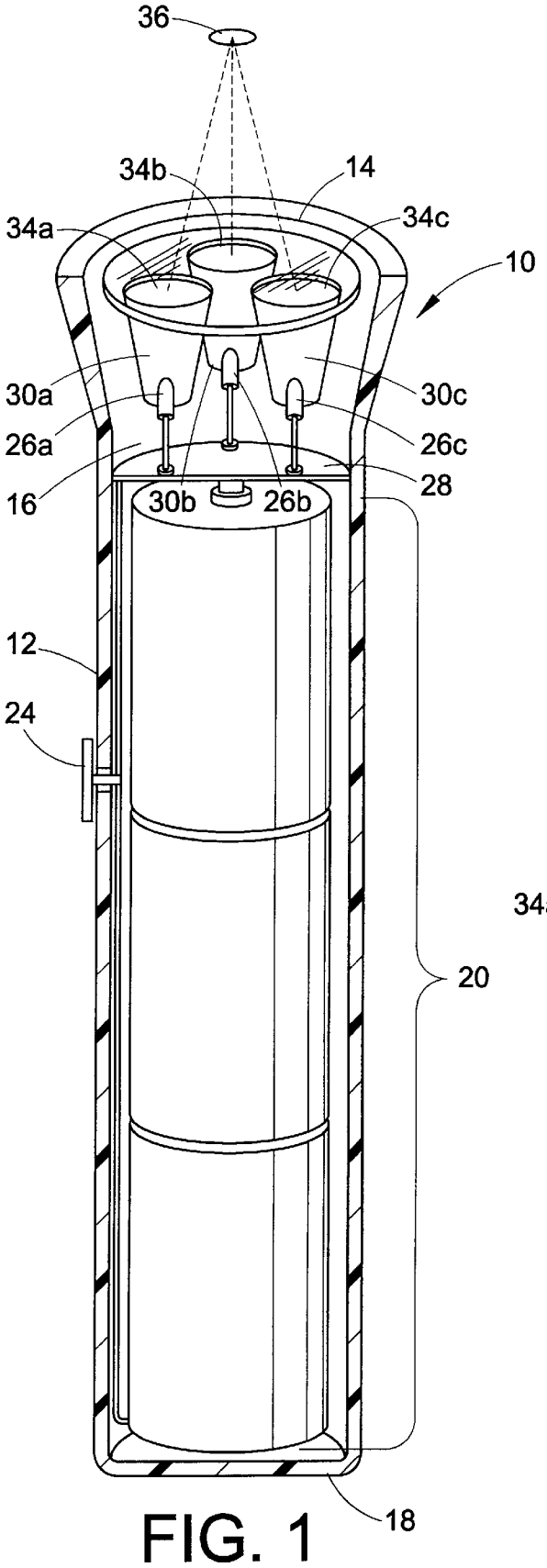
FIG. 1 illustrates a cross-sectional view of an LED flashlight according to the present invention.
Figure 2:
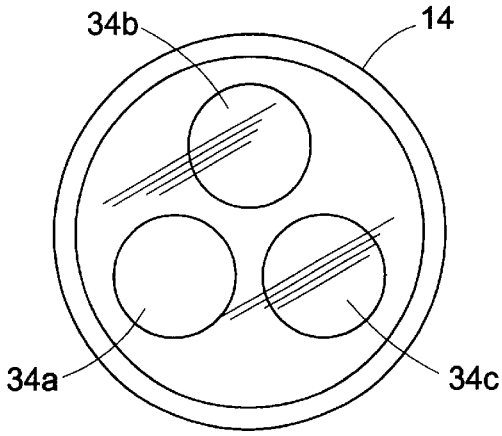
FIG. 2 illustrates a top view of the light source assembly shown in FIG. 1.

With reference to FIGS. 1 and 2, an illumination device 10, or light emitting device (e.g., a flashlight), includes a housing 12 and a light source assembly 14. The housing 12 includes an open end 16 and a closed end 18. The light source assembly 14 is mechanically secured to the housing 12. Preferably, mating threads engage the light source assembly 14 to the housing 12. However, other means (e.g., a snap fit) for securing the light source assembly 14 to the housing 12 are also contemplated.

An electrical power source 24 is included in the housing. Preferably, the power source 20 includes batteries arranged along a coaxial axis. However, other power sources (e.g., a.c. power) are also contemplated. A switch means 24 controls power from the power source 20 to the light source assembly 14.

The light source assembly 14 includes at least one (1) semiconductor light source (e.g., a light emitting diode ("LED")) 26, which is electrically connected to the power source 20 via a printed circuit board ("pcb") 28 mounted substantially at the open end 16 of the housing 12. More specifically, the at least one (1) light source 26 electrically communicates with circuitry on the pcb 28 which electrically communicates with the power source 20. The pcb circuitry regulates electrical power supplied by the power source 20 to the at least one semiconductor light source 26.

In the preferred embodiment, the light source assembly 14 includes three (3) semiconductor light sources 26*a*, 26*b*, 26*c*. The semiconductor light sources 26*a*, 26*b*, 26*c* are seated and secured in respective individual reflector wells 30*a*, 30*b*, 30*c*. Respective individual lenses 34*a*, 34*b*, 34*c* are secured to open ends of the wells 30*a*, 30*b*, 30*c*, respectively. More specifically, the lenses 34 are coupled substantially directly over the wells 30. In this manner, maximum efficiency of the lenses 34 is achieved. Each of the wells 30 is shaped and oriented to direct light produced by the respective semiconductor light source 26 to a predefined direction (e.g., toward a target area 36). More specifically, the wells 30 are designed such that the semiconductor light sources 26*a*, 26*b*, 26*c* are surrounded by the wells 30*a*, 30*b*, 30*c*, respectively. The wells 30 encompass and rise above the light sources 26*a*, 26*b*, 26*c* to collect solid angles of light that are not filled within the optic designated for the light sources 26*a*, 26*b*, 26*c*. Furthermore, the lenses 34 act to direct the light toward the target area 36.

In the preferred embodiment, the lenses 34 are either multiple refractive, refractive/diffractive hybrid lenses, or fresnel lenses. Furthermore, the lenses 34 provide direct light refraction to the respective semiconductor light sources 26 such that the semiconductor light source 26 is imaged between the die (bottom face) and the top of the semiconductor light source assembly 14. In this manner, the light is directed and focussed toward the target area 36.

Preferably, the lenses 34, reflector wells 30, and semiconductor light sources 26 of the light source assembly 14 are matrixed to form a "honeycomb" array pattern.

The matrixed form is designed so as to optimize illumination efficiency and package size for minimum volume. However, other designs for the light source assembly 14 are also contemplated.

The design of the present invention maps the reflector wells 30 and lenses 34 to multiple semiconductor light sources 26 to create uniform, bright beam pattern at the target area 36.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

What is claimed:

1. A light emitting device, comprising:

a plurality of light emitting diodes;

an individual reflector well corresponding to each light emitting diode, in which the light emitting diode is seated; and an individual lens corresponding to each light emitting diode, the lens arranged over an opening of the reflector, light produced by each of the plurality of light emitting diodes being reflected by the reflector and focussed by the lens toward a target area.

2. The light emitting device as set forth in claim 1, wherein the reflector is coupled to the lens.

3. The light emitting device as set forth in claim 1, further including:

a printed circuit board on which the light emitting device is mounted.

4. The light emitting device as set forth in claim 1, wherein the lens provides direct light refraction to the light emitting diode.

5. The light emitting device as set forth in claim 1, wherein the lens is one of a multiple refractive and a refractive/diffractive hybrid lens.

6. The light emitting device as set forth in claim 1, wherein the lenses are matrixed.

7. A flashlight, comprising:

a housing having a closed end and an open end;

an electrical power source in the housing;

a plurality of semiconductor light sources each electrically connected to the power source;

a plurality of reflector wells in which the semiconductor light sources are seated; and a plurality of lenses over the reflectors, the semiconductor light source, reflector, and lens being secured to the housing, light produced by each semiconductor light source being reflected by the reflector and focussed by the lens in a predetermined direction toward a selected target area such that light from the plurality of semiconductor light sources combine to illuminate the target area.

8. The flashlight as set forth in claim 7, wherein each of the reflectors is coupled to a respective one of the lenses.

9. The flashlight as set forth in claim 7, further including:

a printed circuit board, on which each of the semiconductor light sources is electrically mounted, secured substantially at the open end of the housing.

10. The flashlight as set forth in claim 7, wherein each of the semiconductor light sources is a respective light emitting diode.

11. The flashlight as set forth in claim 7, wherein the lenses provide direct light refraction to the respective semiconductor light source.

12. The flashlight as set forth in claim 7, wherein each of the lenses is one of a multiple refractive and a refractive/diffractive hybrid lens.

13. The flashlight as set forth in claim 7, wherein the respective lens, reflector, and semiconductor light sources form an array.

14. A method of manufacturing a light emitting device, comprising:

seating a plurality of light emitting diodes in corresponding reflectors;

securing a lens over each reflector; and adjusting each reflector and lens such that light produced by the corresponding light emitting diode is reflected by the reflector and focussed by the lens toward a target area, wherein light produced by the plurality of light emitting diodes combine at the target area to produce a generally uniform, bright beam pattern at the target area.

15. The method for manufacturing a light emitting device as set forth in claim 14, further including:

seating additional light emitting diode, reflector, and lens within a housing.

16. An LED-based flashlight including:

a housing having a closed end adapted to retain a power supply, and an open end opposite the closed end; and a plurality of light sources arranged at the open end of the housing, each light source including:

a light emitting diode (LED) arranged to receive electrical power from the power supply, a reflector well inside which the LED is seated, the reflector well having an open end, and a lens arranged over the open end of the reflector well and cooperating with the reflector well to direct light produced by the LED away from the housing along a predefined direction, wherein light produced by the plurality of light sources and directed along the predefined directions converge at a target area to produce a substantially uniform beam pattern at the target area.

17. The LED-based flashlight as set forth in claim 16, wherein the reflector well and lens of each light source cooperate to image the LED between a bottom face thereof and a top of the light source.

* * * * *